US010363563B2

(12) United States Patent
Norberg et al.

(10) Patent No.: US 10,363,563 B2
(45) Date of Patent: Jul. 30, 2019

(54) GRINDER PLATE AND TOOL FOR REMOVAL AND INSTALLATION THEREOF

(71) Applicant: Thomas Precision Machining, Inc., Rice Lake, WI (US)

(72) Inventors: Roger Norberg, Prairie Farm, WI (US); Ricky Hall, Weyerhaeuser, WI (US); Gary Novak, Chetek, WI (US); Nathan Kodesh, Rice Lake, WI (US)

( * ) Notice: Subject to any disclaimer, the term of this patent is extended or adjusted under 35 U.S.C. 154(b) by 810 days.

(21) Appl. No.: 15/019,127

(22) Filed: Feb. 9, 2016

(65) Prior Publication Data

US 2016/0228880 A1 Aug. 11, 2016

Related U.S. Application Data

(60) Provisional application No. 62/113,955, filed on Feb. 9, 2015.

(51) Int. Cl.

| | |
|---|---|
| ***B02C 18/00*** | (2006.01) |
| ***B02C 18/36*** | (2006.01) |
| ***B02C 18/30*** | (2006.01) |

(52) U.S. Cl.

CPC ..... *B02C 18/365* (2013.01); *B02C 18/30* (2013.01); *B02C 18/302* (2013.01); *B02C 18/305* (2013.01); *B02C 18/36* (2013.01)

(58) Field of Classification Search

CPC ..... B02C 18/30; B02C 18/302; B02C 18/305
USPC ..... 241/82.1, 101.2
See application file for complete search history.

(56) References Cited

U.S. PATENT DOCUMENTS

| | | | | |
|---|---|---|---|---|
| 1,343,351 A * | 6/1920 | Collins | B25B 27/00 29/270 |
| 2,539,448 A * | 1/1951 | Lundell | B02C 18/302 241/285.1 |
| 3,125,144 A * | 3/1964 | Lundell | B02C 18/305 241/285.1 |
| 3,414,925 A * | 12/1968 | Stavros | B02C 18/34 15/104.001 |
| 5,177,853 A * | 1/1993 | Herook | B25B 27/14 29/266 |
| 8,100,355 B2 * | 1/2012 | Hagedorn | A22C 11/0209 15/104.001 |
| 2009/0224085 A1 * | 9/2009 | Hagedorn | A22C 11/0209 241/16 |

OTHER PUBLICATIONS

Weiler and Company; Wieler Meat Grinders Intallation, Operation, and Maintenance Instructions; Sep. 1979.

* cited by examiner

*Primary Examiner* — Faye Francis
(74) *Attorney, Agent, or Firm* — Carlson, Caspers, Vandenburgh & Lindquist, P.A.

(57) ABSTRACT

An embodiment described herein provides for a system for removing or installing a grinder plate. The system includes a grinder plate having a disk shaped body which defines a central cylindrical aperture extending therethrough and a first one or more screw threads are defined in the central aperture. The system also includes a plate handling tool having an elongated body defining a second one or more screw threads on an external surface proximate the first end. The first one or more screw threads of the plate are configured to mate with the second one or more screw threads of the tool.

17 Claims, 15 Drawing Sheets

GRINDER PLATE AND TOOL FOR REMOVAL AND INSTALLATION THEREOF

CROSS-REFERENCE TO RELATED APPLICATIONS

This application claims the benefit of U.S. Provisional Patent Application No. 62/113,955, filed on Feb. 9, 2015.

BACKGROUND

An industrial grinder takes in whole items or large chunks and grinds them to form smaller pieces. Industrial grinders can be used to grind whole animals, animal parts, vegetables, fruit, cheese, nuts, or other materials. A grinder plate is a disk-shaped component in such an industrial grinder that includes a plurality of apertures though which the material is pressed. One or more blades typically operate near or against a surface of the grinder plate to cut the material into smaller pieces to aid in pressing the material through the plurality of apertures in the grinder plate.

A grinder plate is removed from an industrial grinder for various reasons including to check the wear level of the grinder plate, knife blades, or other parts, to replace the grinder plate, or to clean out the grinder (e.g., to remove foreign material). Grinder plates may be replaced due to excessive wear or when it is desired to use a grinder plate having a different configuration of apertures (e.g., apertures of a different size and/or location). For example, a different configuration of apertures may be used for different materials to-be-ground or for different desired material size after grinding.

Some grinders have grinder plates that are set deep within a housing. These grinder plates are accessed through an opening at one end of the housing, and are located within the housing some distance away from that opening. The grinder plates in these grinders are typically mechanically supported by the interior of the housing. As such, there is typically no space between the side of the grinder plate and the housing. Since the grinder plates have a flat forward-facing surface with no space on the sides, it is difficult to grab the grinder plate in order to remove it from the grinder. Moreover, there is often suction caused by worked material behind the plate that resists movement of the grinder plate; adding to the difficulty of removing the grinder plate.

In order to release the suction to allow removal of such a grinder plate, the operator is often forced to use one of several methods. First, the operator may start power of the grinder for a short period of time while the housing is opened and the grinder plate and other components (e.g., knife assembly) are not mechanically secured in place. Another method is to pound the plate with a hard object such as a metal bar. A third method is to run water into the grinder to rinse away the worked material from around the grinder plate. These methods take time, present safety risks, can create a mess in and around the grinder, and/or can cause damage to the grinder, each of which is valuable during operation.

BRIEF DESCRIPTION

An embodiment described herein provides for a system for removing or installing a grinder plate. The system includes a grinder plate having a disk shaped body with a first face, a second face, and a side. The body defines a central cylindrical aperture extending from the first face to the second face, the central aperture coaxial with a central axis of the body. The body also defines a plurality of material-passing apertures extending from the first face to the second face, the material-passing apertures disposed between the central aperture and the side. A first one or more screw threads are defined in the central aperture. The system also includes a plate handling tool having an elongated body defining a first end having a cylindrical geometry and a second one or more screw threads on an external surface proximate the first end. An axis of the second one or more screw threads is aligned with a central longitudinal axis of the elongated body. The tool also defines at least one of a head configured for mating with a standard non-adjustable wrench or one or more handles extending from the body, each of the one or more handles projecting outward in a perpendicular direction to the central axis of the body. The first one or more screw threads of the plate are configured to mate with the second one or more screw threads of the tool.

Another embodiment provides for a grinder plate having a disk shaped body with a first face, a second face, and a side. The body defines a central cylindrical aperture extending from the first face to the second face, the central aperture coaxial with the central axis of the body. The body also defines a plurality of material-passing apertures extending from the first face to the second face, the material-passing apertures disposed between the central aperture and the side. One or more screw threads are defined in the central aperture, the one or more screw threads having a pitch and lead matching a mating thread on a plate handling tool.

Yet another embodiment provides for a tool for installing or removing a grinder plate. The tool includes an elongated body defining a first end having a cylindrical geometry and one or more screw threads on an external surface of the first end. The one or more screw threads have a pitch and lead matching a mating thread of a central aperture of a grinder plate. The tool also defines a bore in the first end, the bore having a cylindrical geometry, the cylindrical geometry coaxial with the axis of the one or more screw threads, wherein a wall defining the bore is less than one half inch thick. The tool also includes at least one of a head defining a plurality of flat surfaces disposed as sides of a regular polygon or one or more handles extending from the body, each of the one or more handles projecting outward in a perpendicular direction to the central axis of the body.

BRIEF DESCRIPTION OF THE DRAWINGS

Understanding that the drawings depict only examples and are not therefore to be considered limiting in scope; the examples will be described with additional specificity and detail through the use of the accompanying drawings.

In accordance with common practice, like reference numbers and designations in the various drawings indicate like elements.

DETAILED DESCRIPTION

Figure 1A:
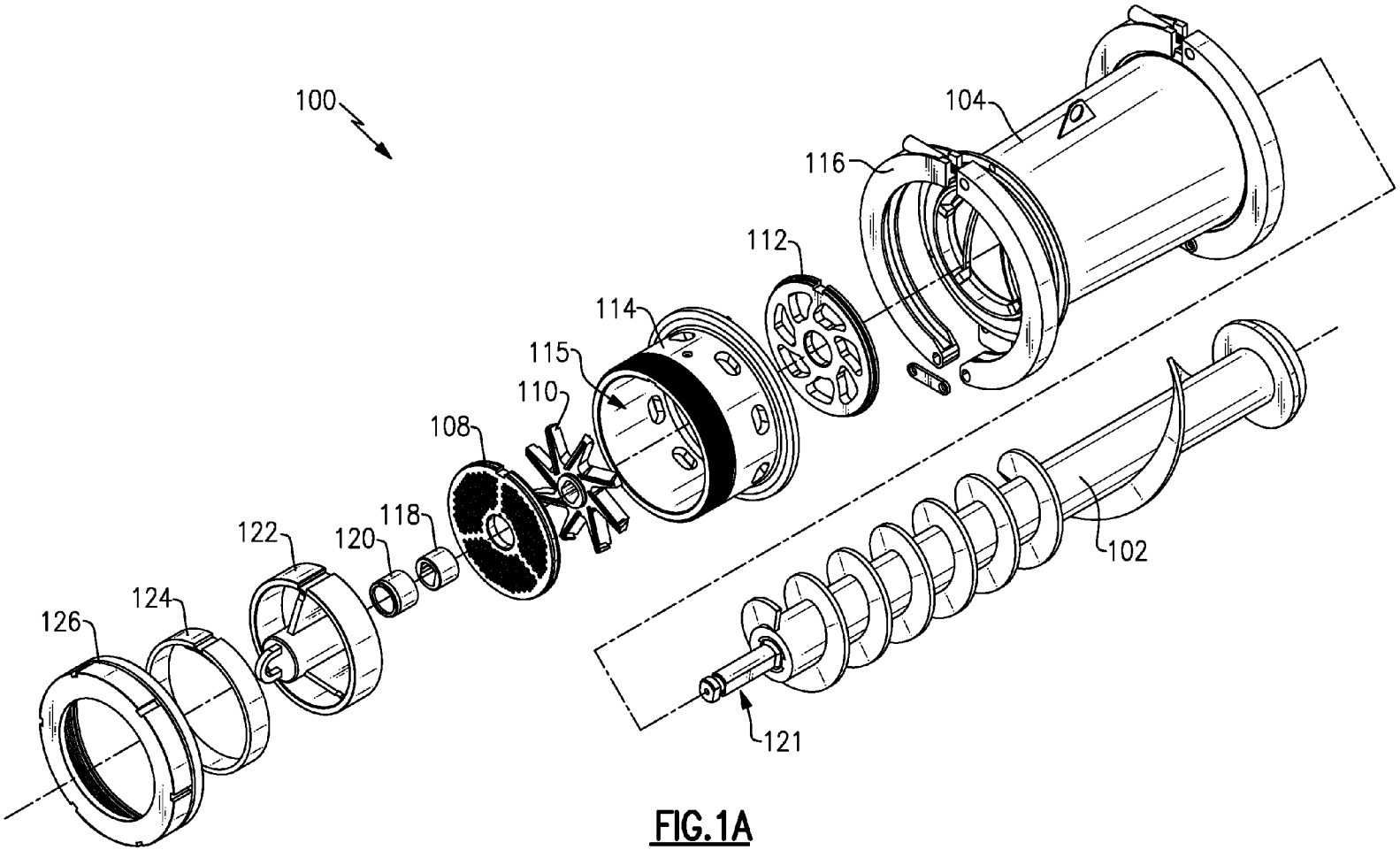
FIG. 1A is an exploded view of a portion of an example industrial grinder.
Figure 1B:
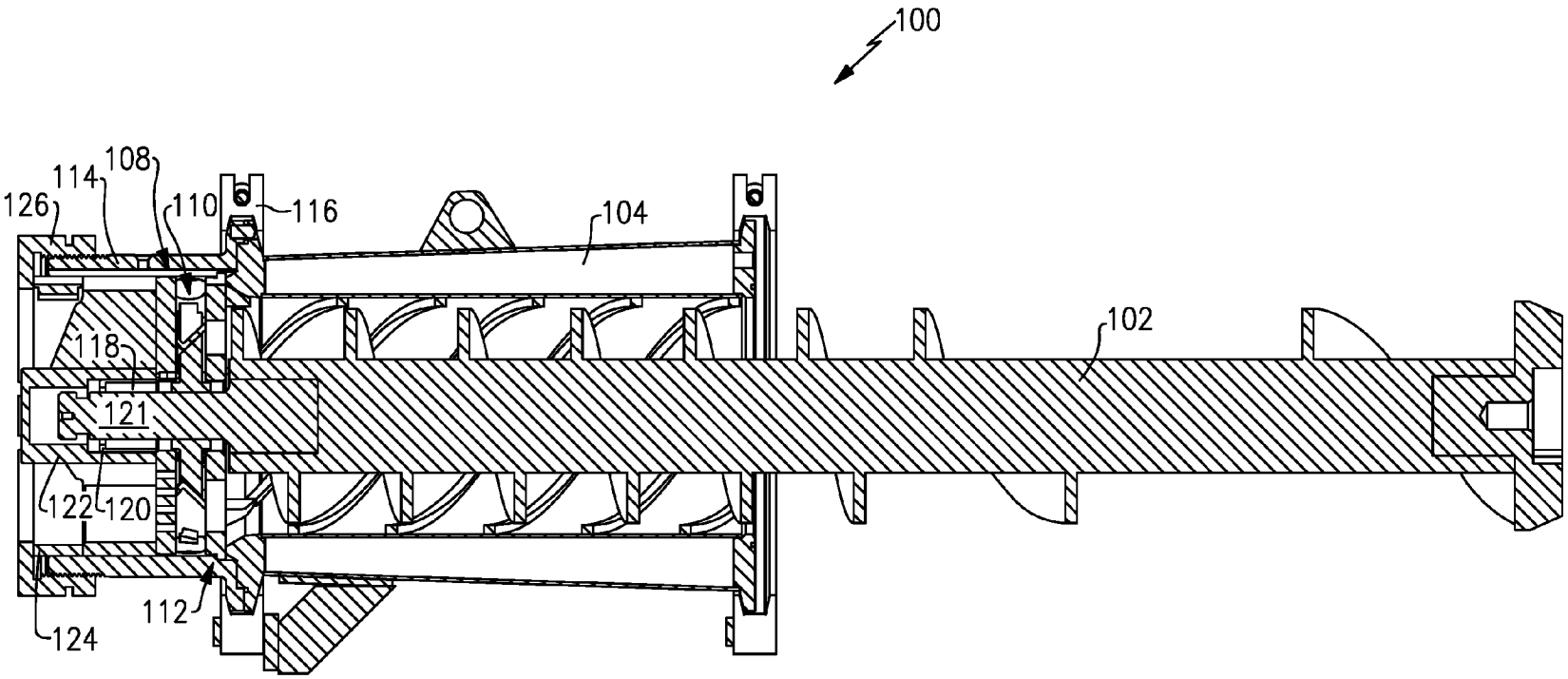
FIG. 1B is a cross-sectional view of the example grinder of FIG. 1A.

FIG. 1A is an exploded view and FIG. 1B is a cross-sectional view of a portion of an industrial grinder 100. The grinder 100 includes an auger 102 that is disposed within a housing 104. The auger 102 includes one or more flightings. In operation, the auger 102 is rotated within the housing 104, causing the flightings to move the worked (e.g., to-be-ground) material toward a first end of housing 104. The internal surface of the housing 104 can include a plurality of grooves or ridges to assist in moving the worked material toward the first end.

The auger 102 moves the worked material toward a grinder plate 108 and a knife assembly 110. The knife assembly 110 includes one or more knife blades and is disposed closely to the grinder plate 108 such that the knife blades are disposed near or against a surface of the grinder plate 108. The knife assembly 110 is mechanically coupled to the auger 102, such that the knife assembly 110 rotates along with the auger 102. In operation, the knife assembly 110 is rotated which causes the knife blades therein to cut the worked material via the interaction of the knife blades and the grinder plate 108. In this example, the portion of the grinder 100 shown in FIGS. 1A and 1B includes a pre-cutter plate 112, and the knife assembly 110 is disposed between the grinder plate 108 and the pre-cutter plate 112, which are oriented parallel to one another. The pre-cutter plate 112, knife assembly 110, and grinder plate 108 are disposed within a housing extension 114, which is removably fastened to the housing 104 with one or more fastening members 116, such as a ring clamp.

Forward of the grinder plate 108, an auger support 122 is used to support a terminus 121 of the auger 102. In particular, the terminus 121 of the auger 102 is mechanically coupled to an internal bushing 118 that rotationally bears against an external bushing 120. The external bushing 120 is mounted (e.g., mechanically pressed) within the auger support 122 to maintain the position of the terminus 121 of the auger 102. In many designs, the terminus 121 of the auger 102 is a centering pin that is mechanically coupled to a main body of the auger 102 such that the centering pin rotates with the main body. A spacer ring 124 can be disposed between the auger support 122 and a retaining ring 126. The retaining ring 126 can be removably fastened to the housing extension 114, such as via mating screw threads on the retaining ring 126 and the housing extension 114. The retaining ring 126 holds the spacer ring 124, auger support 122, grinder plate 108, knife assembly 110, and pre-cutter plate 112 in place within the housing extension 114 by pressing them against a shoulder of the housing 100.

The movement of the worked material by the auger 102 presses the worked material against the grinder plate 108. This pressure, aided by the cutting of the knife assembly 110, presses the worked material through material-passing apertures in the grinder plate 108. The worked material on the other side of the grinder plate 108, which is now reduced in size, is pressed out of a front opening 115 of the housing extension 114 by the force of the material behind it.

As can be seen in FIG. 1B, the grinder plate 108 is disposed deep within the housing extension 114. To remove the grinder plate 108, the retaining ring 126 is unfastened from the housing extension 114, and the spacer ring 124, auger support 122 with bushing 120, and bushing 118 are removed. The grinder plate 108 can then be accessed through the front opening 115 of the housing extension 114. As discussed in the background, the side of the grinder plate 108 contacts the internal surface of the housing extension 114, such that the housing extension 114 circumferentially supports the grinder plate 108.

Figure 2A:
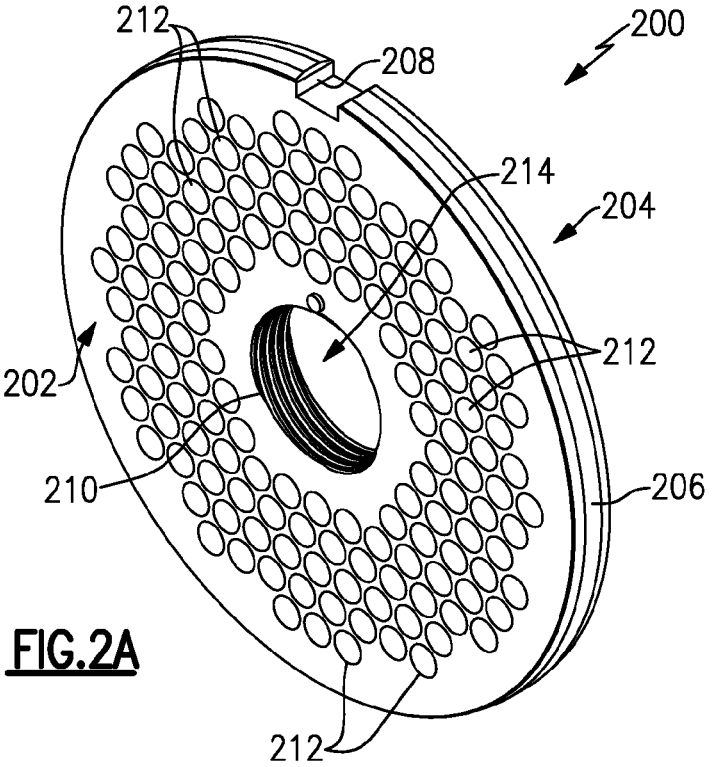
FIGS. 2A and 2B are perspective views of an example grinder plate for use in the grinder of FIG. 1A.
Figure 2B:
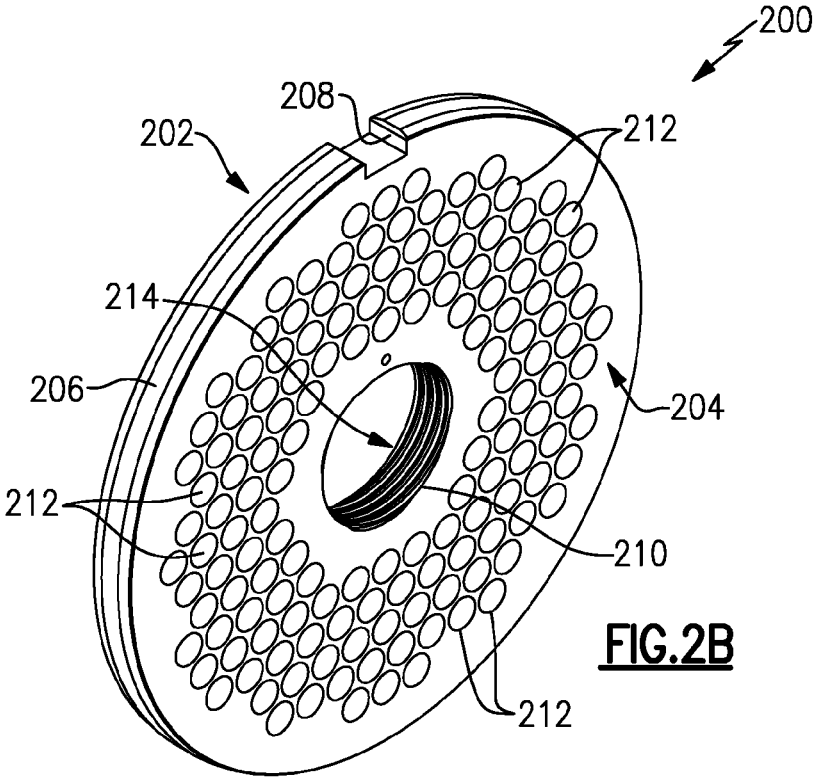

FIGS. 2A and 2B are perspectives view of an example grinder plate 200. The grinder plate 200 has a disk shaped body having a first face 202, a second face 204 reverse of the first face 202, and a side 206 which forms the surface abutting the outer edges of the first face 202 and second face 204. The first face 202 and second face 204 are flat surfaces oriented in parallel with one another. The side 206 can be a smooth surface and can be slightly rounded or otherwise be angled inward near the intersection with the first face 202 and second face 204 respectively. A notch 208 can be defined in the side 206. The notch 208 can mate with a corresponding feature on the housing extension 114 to prevent rotation of the plate 200 within the housing extension 114. The plate 200 has a diameter that corresponds to an inside diameter of a housing (e.g., housing extension 114). As a disk shaped body, the thickness (i.e., the distance between the first face 202 and the second face 204) of the plate 200 is substantially less than (e.g., less than about $1/4^{th}$ of) a diameter of the plate 200. Typical grinder plates range from 100 to 500 mm in diameter and from 10 to 50 mm thick, although any appropriate diameter or thickness can be used.

The plate 200 defines a central aperture 210 having a cylindrical geometry. The central aperture extends entirely through the plate 200 from the first face 202 to the second face 204. An axis of the cylindrical central aperture 210 is aligned with the axis of the disk shaped body overall. Thus, the central aperture 210 is disposed in the center of the disk. The central aperture 210 provides space for the terminus 121 of the auger 102 to extend therethrough, past the plate 200 such that the terminus 121 of the auger 102 can couple with auger support 122 via the bushings 118, 120. Since the plate 200 does not rotate, the central aperture 210 has a diameter large enough such that there is clearance between the terminus 121 of the auger 102 disposed within the central aperture 210 and the surface of the central aperture 210. Typical central apertures 210 have a diameter ranging from 20 to 150 mm in diameter, although any appropriate diameter can be used.

The plate 200 also includes a plurality of material-passing apertures 212. The material-passing apertures 212 are disposed between the central aperture 210 and the side 206 and extend entirely through the plate 200 from the first face 202 to the second face 204. The material-passing apertures 202 are typically much smaller than the central aperture 210 to facilitate the reduction in size of the worked material;

however, the diameter of the material-passing apertures 202 depends on the intended purpose and position of the plate within a grinder. Additionally, the plate 200 shown in FIGS. 2A and 2B illustrates an example pattern in which the material-passing apertures 212 are laid-out across the plate 200, however, it should be understood that any desired pattern can be used. The material-passing apertures 212 on a plate 200 often all have the same geometry, such that each material-passing aperture 212 has a common effect on the worked material. For example, each material-passing aperture 212 on a plate 200 can have a circular cross-section having a consistent diameter through the thickness of the plate 200, and all of the material-passing apertures 212 on the plate 200 can have the same consistent diameter. In another example, each material-passing aperture 212 can have a circular cross-section having a stepped or tapered diameter, and all of the material-passing apertures 212 on the plate 200 can have the same stepped or tapered diameter. Although the example plates 200 shown herein have material-passing apertures 212 with a circular cross-section, other cross-sectional shapes can be used such a square or an elongated shape forming a slot.

In some embodiments, the plate 200 can include a small number (e.g., 3 or less) of subsets of material-passing apertures 212, each subset having a common geometry within the subset, but a different geometry from apertures 212 in other subsets. Such a configuration of multiple subsets can be used to account for variation in pressure across the face 202 of the plate 200, for situations in which the worked material is separated into distinct streams (e.g., to separate harder material from softer material) or for other reasons. In most cases, however, each material-passing aperture will have a common geometry with many (e.g., at least 25) of the other material-passing apertures 212.

In some examples such as the example shown in herein, the plate 200 is configured for use in a single direction, such that only the first face 202 is intended to face the knife assembly 110. In such examples, plate 200 is not intended to be used with the second face 204 facing the knife assembly 110. Such single-direction configuration can include material-passing apertures 212 having a varied width or geometry along the thickness of the plate 200. An implementation of a material-passing aperture 212 having a varied width or geometry is a material-passing aperture 212 having a decreasing size (e.g., stepped or tapered size) from the first face 202 to the second face 204. Another implementation of a single-direction configuration includes a bone pin aperture (described in more detail below) having a diameter that is smaller at the second face 204 that at the first face 202. In other examples, however, the plate 200 is designed so that either face 202, 204 can be positioned towards the knife assembly 110. In these other examples, the first face 202 and the second face 204 can be identical.

The inner surface of the central aperture 210 has one or more internal screw threads 214 defined therein. The one or more screw threads 214 (also referred to herein as simply "threads") can be female threads defined in the inner surface of the central aperture 210. The threads 214 are configured to mate with a corresponding one or more external screw threads on a plate handling tool. That is, the threads 214 have a pitch and lead that matches the pitch and lead of threads in the plate handling tool. The threads 214 and the plate handling tool are described in more detail below.

Plate 200 and plate 108 are both suitable for use in the position of plate 108 in grinder 100 and are included herein to illustrate two example configurations of material-passing apertures 212. For succinctness some of the description with respect to plate 108 is not repeated for plate 200, and some of the description with respect to plate 200 is not repeated for plate 108. However, the description with respect to plate 108 also applies to plate 200 and the description with respect to plate 200 also applies to plate 108. The only difference between plate 108 and plate 200 is the configuration (i.e., size, positioning) of their respective material-passing apertures 212. Accordingly, similar reference numerals are used for plate 108 and plate 200.

Figure 3A:
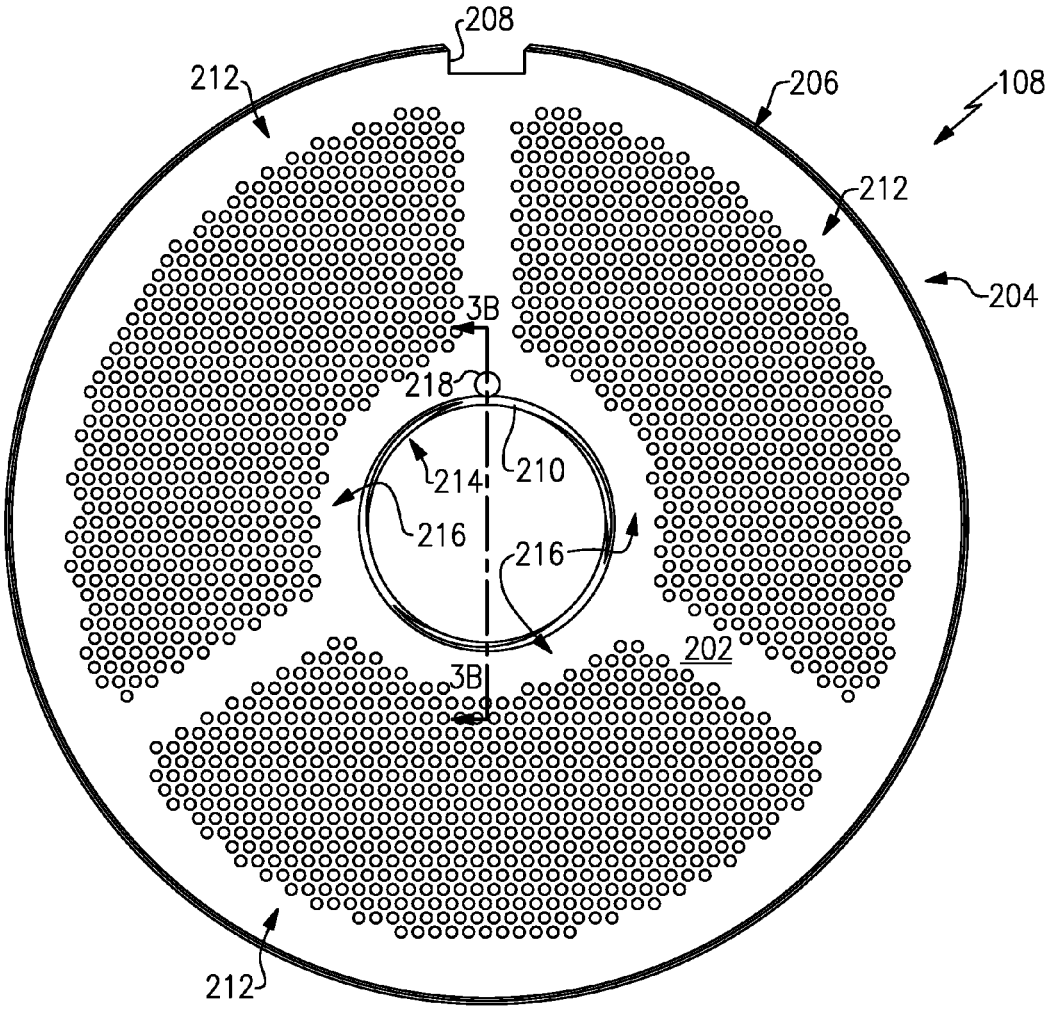
FIG. 3A is a front view of another example grinder plate for use in the grinder of FIG. 1A.

FIG. 3A is a front view of the grinder plate 108. As shown, the example plate 108 includes an exclusion region 216, which is an annular shaped area adjacent to and around the central aperture 210 in which no material-passing apertures 212 are present. The radially inner edge of the exclusion region 216 is demarked by the central aperture 210 and the radially outer edge of the exclusion region 216 is demarked by a circle tangential to the radially innermost material-passing apertures 212. No material-passing apertures 212 are disposed in this exclusion region 216, because this region is radially inside (with respect to the axis of rotation) of the area in which the blades of the knife assembly 110 pass. Thus, it would be more difficult to press worked material through the plate 108 in this region. In an example, the exclusion region 216 extends radially outward from the edge of the central aperture 210 in the range of 0.25 to 2 inches.

In an example, the plate 108 includes a bone pin aperture 218 within the exclusion region 216. The bone pin aperture 218 is typically a single aperture having a different diameter than the material-passing apertures 212. The bone pin aperture 218 is not used for material-passing, so its diameter is not limited by the desired interaction with (e.g., resulting dimension of) the ground material as are the material-passing apertures 212. During operation a bone pin is inserted into the bone pin aperture 218.

Figure 3B:
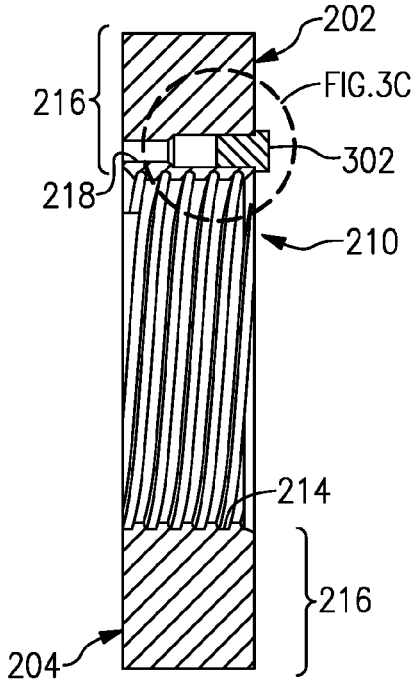
FIG. 3B is a cross-sectional view of a central portion of the grinder plate of FIG. 3A.
Figure 3C:
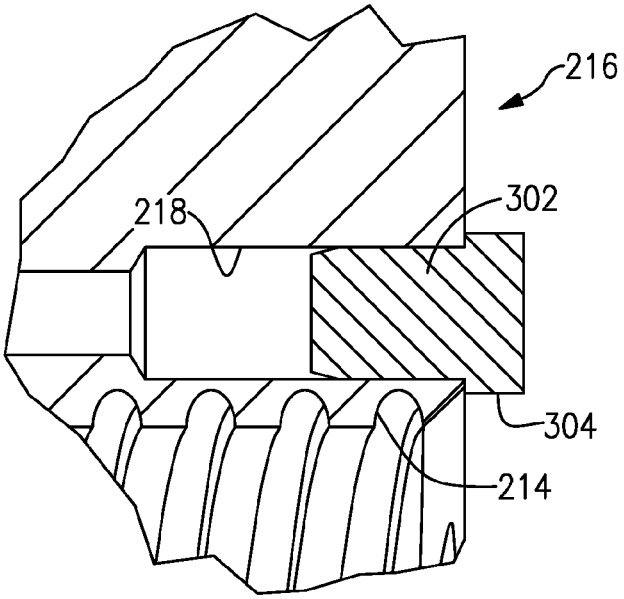
FIG. 3C is an enlarged cut-away cross-sectional view showing the threads and bone pin aperture of the grinder plate of FIG. 3A.

FIG. 3B is a cross-sectional view a central portion of the plate 108 showing the central aperture 210 with a bone pin 302 inserted therein. FIG. 3C is a cut-away cross-sectional view of the central portion of the plate 108 showing the bone pin aperture 218 and bone pin 302 in more detail. In an example, the bone pin aperture 218 and the bone pin 302 are cylindrical in geometry. The diameter of the bone pin aperture 218 and the bone pin 302 correspond, such that the bone pin 302 can be inserted into the bone pin aperture 218 and held therein with friction between the bone pin 302 and the bone pin aperture 218. The bone pin 302 is also configured such that a portion of the bone pin 302 will extend out past the plane of the first face 202 after installation into the aperture 218. In an example, the bone pin 302 is mechanically pressed into the bone pine aperture 218.

It is not desirable to have worked material in the area adjacent the exclusion region 216 as worked material in this area can add undesired pressure forcing the knife assembly 110 away from the plate 108, increase wear on the plate 108 and knife assembly 110, and create heat which can be bad for the worked material. The portion of the bone pin 302 that projects outward from the first face 202 aids in breaking up bone or other worked material adjacent the exclusion region 216 as the knife assembly 110 rotates. Breaking up the material adjacent the exclusion region 216 can reduce buildup of the material in that area.

The example bone pin 302 shown herein includes a flange 304 that bears against the first face 202 of the plate 108 when the bone pin 302 is inserted into the bone pin aperture 218. In an alternative example, the bone pin 302 can have a consistent diameter along its length, such that the bone pin 302 does not include a flange 304. The bone pin aperture 218 can include a stepped diameter which decreases from its diameter at the first face 202 creating a shoulder which the bone pin 302 can bear against. Thus, the bone pin 302 can be inserted into the aperture 218 until it bears against the shoulder. In an example, the bone pin aperture 218 extends entirely through the plate 108 from the first face 202 to the second face 204. In an example, the edge of the bone pin aperture 216 is within one tenth of an inch of central aperture 210.

Although the bone pin 302 need not extend all the way through the plate 108, having an opening to the bone pin aperture 218 from the second face 204 enables the bone pin 304 to be pushed out of the bone pin aperture 218 from the opposite side. It may be desirable to remove the bone pin 302 during refurbishing of the plate 108 or for other reasons. Since the example plate 108 is not intended to be used with the second face 204 facing the knife assembly 110, the bone pine aperture 218 is not configured to have a bone pin 302 inserted therein from the second face 202. Accordingly, the diameter of the bone pin aperture 218 at the second face 204 can be a different size (e.g., smaller) than its diameter at the first face 202.

Figure 4A:
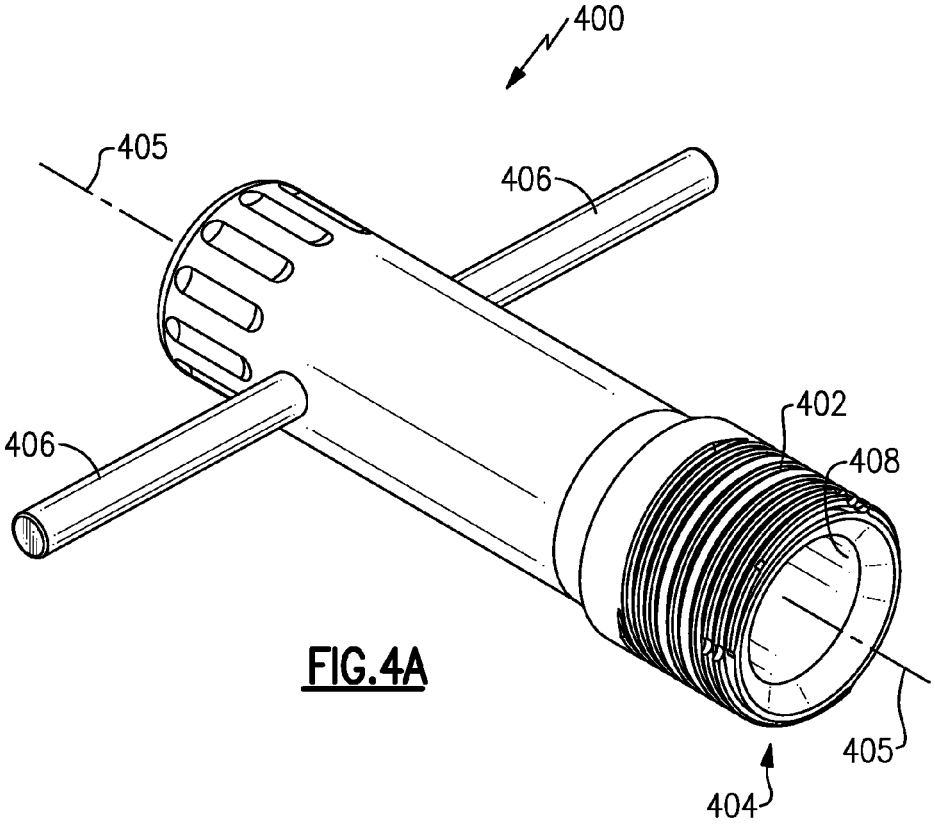
FIGS. 4A and 4B are perspective views of an example plate handling tool.
Figure 4B:
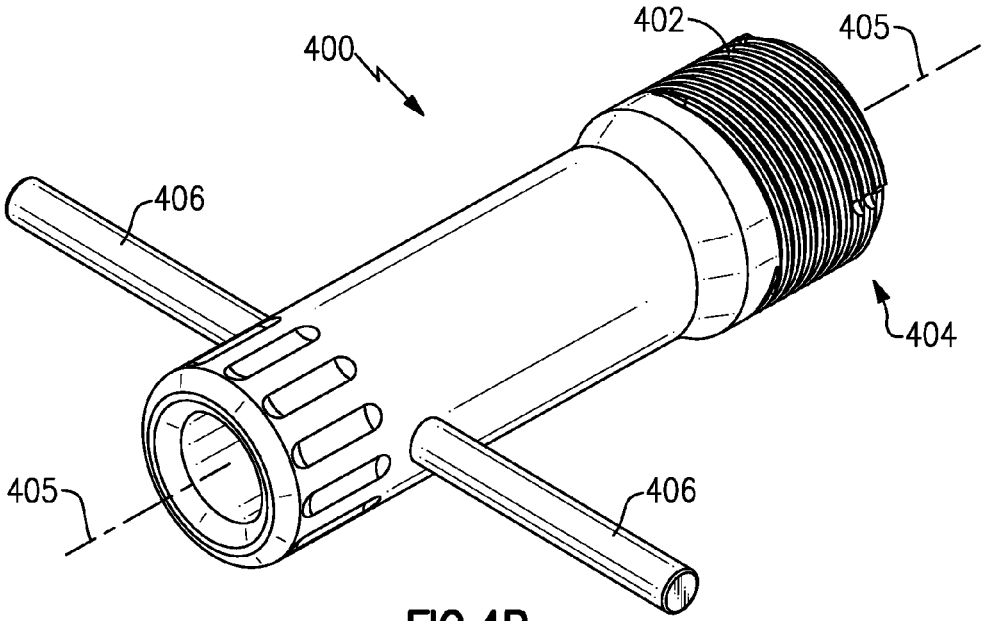
Figure 4C:
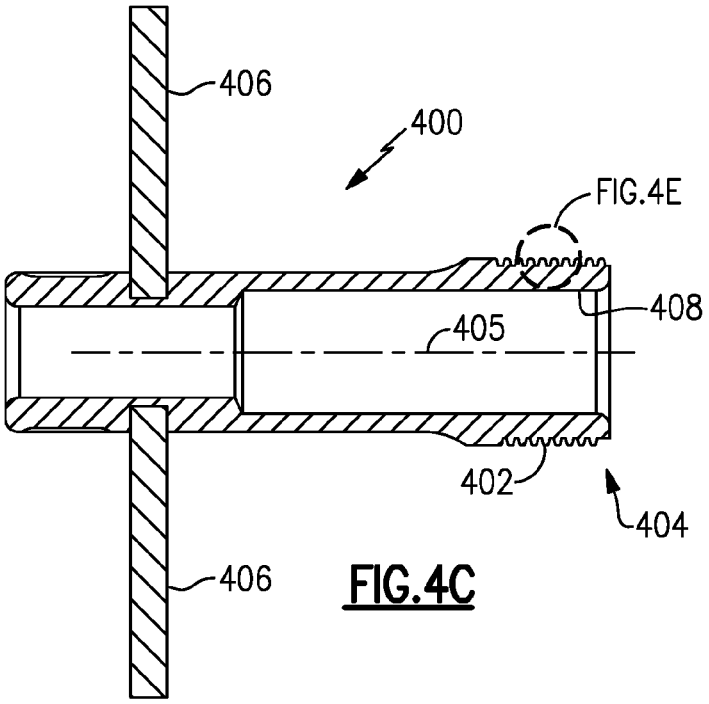
FIG. 4C is a cross-sectional view of the plate handling tool of FIG. 4A.

FIGS. 4A and 4B are perspective views of an example plate handling tool 400 and FIG. 4C is a cross-sectional view of the example tool 400. The plate handling tool 400 has an elongated body with one or more external screw threads 402 proximate a first end 404 thereof. The one or more screw threads 402 (also referred to herein as simply "threads") are configured to mate with the threads 214 in the central aperture 210 of the plate 108. That is, the threads 402 have a pitch and lead that matches the pitch and lead of the threads 214. Additionally, the threads 402 can be male threads to mate with female threads 214. In an example, the threads 402, 214 are three start threads having a pitch of $1/6^{th}$ of an inch, resulting in a one half inch lead. In other examples, however, other numbers of starts and/or pitches can be used. In an example the threads 214, 402 are right hand threads, however, in an alternative example left hand threads 214, 402 are used. The diameter of the first end 404 also corresponds to the diameter of the central aperture 210. Since a given tool 400, 500 corresponds to a given diameter of central aperture 210, a different tool 400, 500 is used for a plate 108, 200 having a different sized central aperture 210.

To present an efficient design, the axis of rotation for the threads 402 can be aligned with a central longitudinal axis 405 of the body. Thus, the body can be rotated to rotate the threads 402 about their axis of rotation.

At least the first end 404 of the tool 400 has a cylindrical geometry to enable mating of the threads 402 with the threads 214 in the cylindrical central aperture 210 of the plate 108. In this example, the entire body of the tool 400 is generally cylindrical, although this need not be the case in other examples. The elongated body of the tool 400 enables easier engagement of the tool 400 with a plate 108 installed deep within a housing (e.g., housing extension 114). In an example the tool 400 is at least 6 inches long in the longitudinal direction. Spaced apart from the first end 404, the tool 400 can include at least one feature that enables sufficient torque to be placed onto the tool 400 to successfully engage with and loosen plate 108 installed in a housing. In an example, the at least one feature includes one or more handles 406 that extend from the body. Such a handle 406 can project outward from the body in a direction perpendicular from the central longitudinal axis 405 of the body in a manner that enables the handle to be gripped with a hand. In this example, the handles 406 include a plurality of straight rods projecting out from the body in a direction perpendicular to the central axis 405. In this example, two co-linear rods extending out at least 3 inches in opposite directions are used forming a general "T" shape with the tool 400. In other example, however, other numbers and positions of rods can also be used. Additionally, although the example handles 406 shown in FIG. 4 are straight rods, in other examples a handle 406 can have other geometries including a curved member that joins the body at multiple locations.

Figure 5:
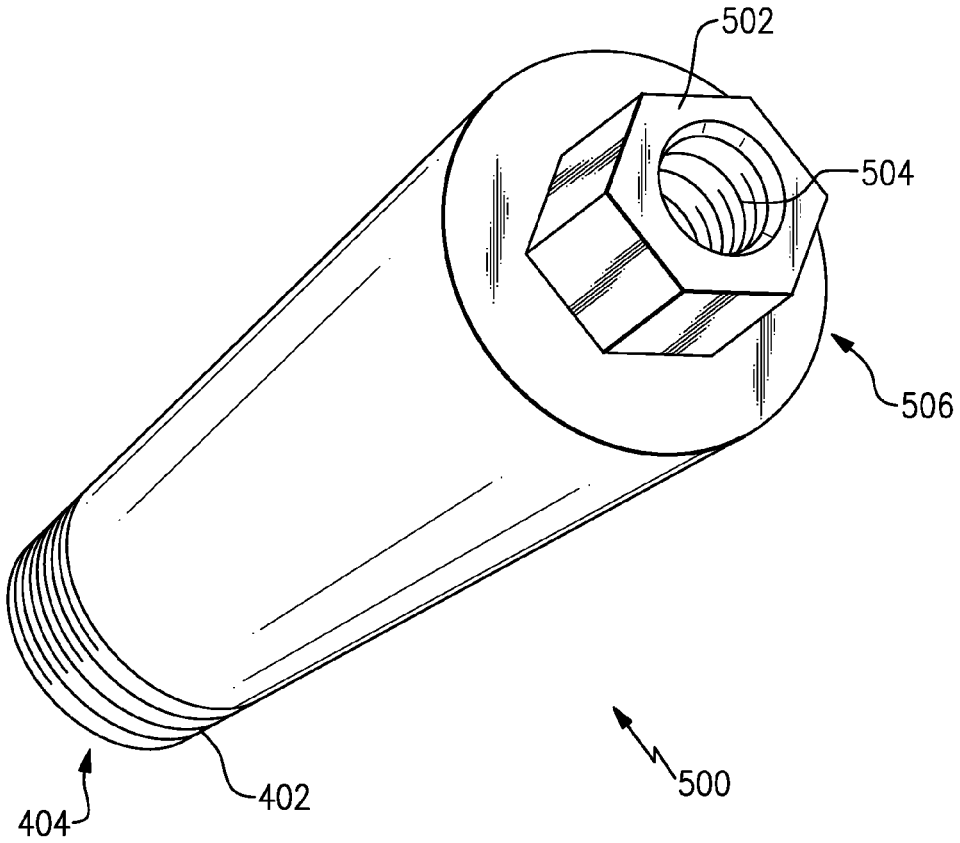
FIG. 5 is a perspective view of another example plate handling tool.

FIG. 5 is another example of a plate handling tool 500 in which the at least one feature for applying torque thereto is a standard head 502 configured for engaging with a non-adjustable wrench. For instance, a standard head as is used on a common bolt or nut could be used. An example non-adjustable wrench is a combination open/closed end wrench having a standard size such as ¾ inch or 15 mm. As known, such a head can include a plurality of flat surfaces that are disposed as sides of a regular polygon. The central axis of the regular polygon can be aligned with the axis 405 of rotation of the threads 402 such that rotation of the head with a wrench 502 rotates the threads 402 about their axis of rotation. In some examples, a plate handling tool can include both a standard head and one or more handles.

Tool 400 and 500 are both suitable for use with plate 108, 200 described herein. For succinctness some of the description with respect to tool 400 is not repeated for tool 500 and some of the description with respect to tool 500 is not repeated for tool 400. However, the description with respect to tool 400 also applies to tool 500 and the description with respect to tool 500 also applies to tool 400. The two tools 400, 500 are illustrated to show two different example features for applying torque thereto. Accordingly, similar reference numerals are used for tool 400 and tool 500.

Figure 6:
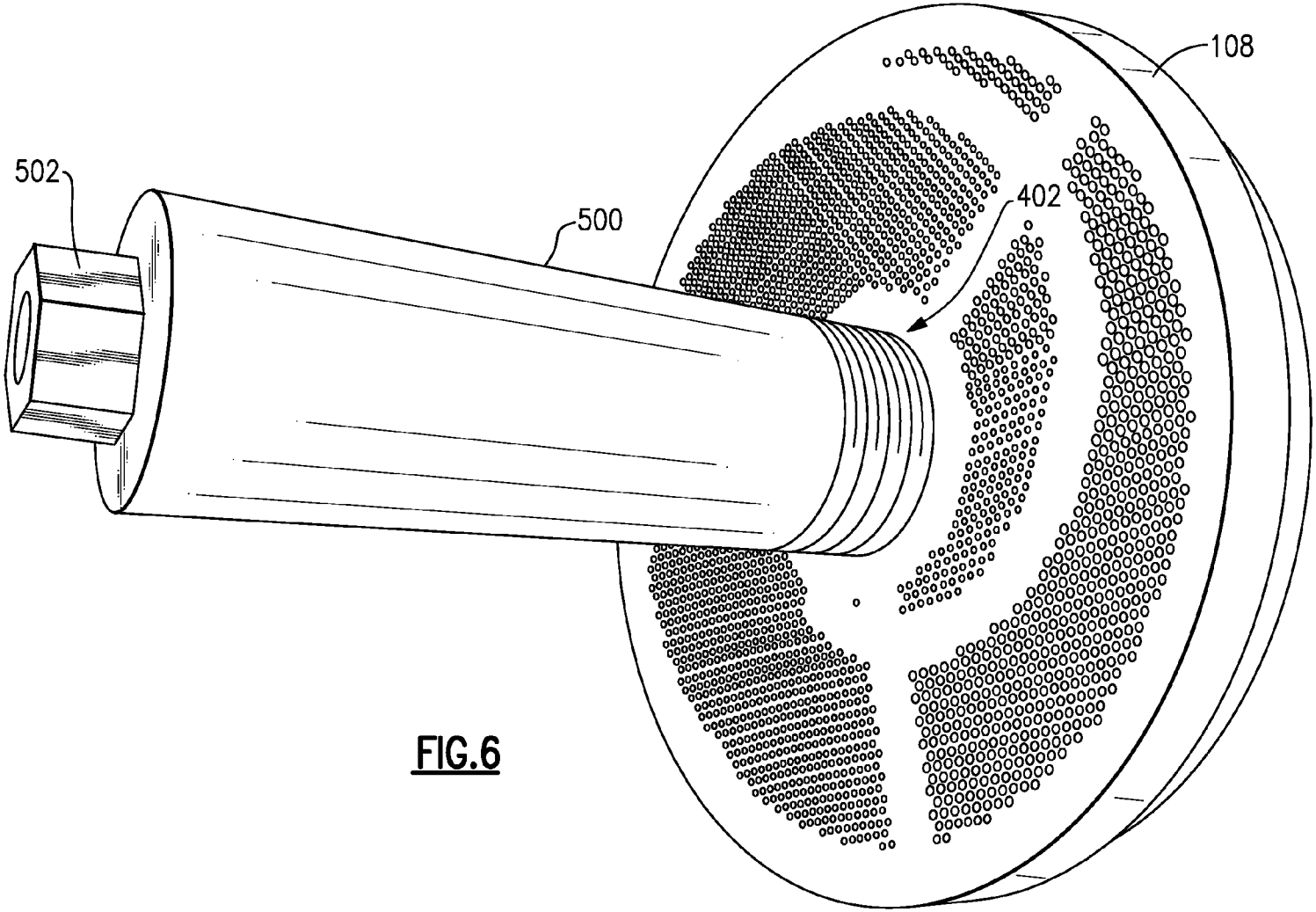
FIG. 6 is a perspective view of the plate handling tool of FIG. 5 engaged with the grinder plate of FIG. 3A.

FIG. 6 is a perspective view of the threads 402 of the tool 500 engaged with the threads 214 of an example plate 108. As shown, the first end 404 of the tool 500 can be aligned with the central aperture 210 of the plate 108 and rotated with respect to the plate 108 to engage the tool 500 with the plate 108.

Referring back to FIGS. 4A and 4B, the tool 400 includes a bore 408 in the first end 404. The bore 408 has a cylindrical geometry that extends longitudinally into the first end 404 and is centered about the axis 405 of rotation of the threads 402. The bore 408 is provided to enable the tool 400 to be inserted around the terminus 121 of the auger 102 as the tool 400 is brought up to and engaged with the plate 108 installed in a housing. Accordingly, the bore 408 has a diameter that is at least as large as the largest outside diameter of the terminus 121 of the auger 102. Ideally, the diameter of the bore 408 provides some clearance from the terminus 121 of the auger 102 to enable the terminus 121 of the auger 102 to slide through the bore 408. However, the diameter of the bore 408 can be selected to be only slightly larger than a width of the terminus 121 such that there is little play between the 400 and the terminus 121. In such a situation, sliding the tool 400, 500 along the terminus 121 will align the tool 400 with the central aperture 210 of the plate 108. In an example, the wall of the tool defining the bore 408 between the bore 408 and the threads 402 is less than one half inch thick. This wall is thin enough to fit between the central aperture 210 of the plate 108 and the terminus 121 of the auger 102 extending through the central aperture 210.

Figure 4E:
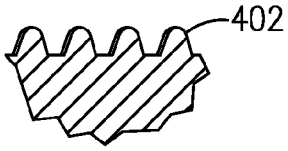
FIG. 4E is an enlarged cut-away cross-sectional view showing the threads of the plate handling tool of FIG. 4A.
Figure 4D:
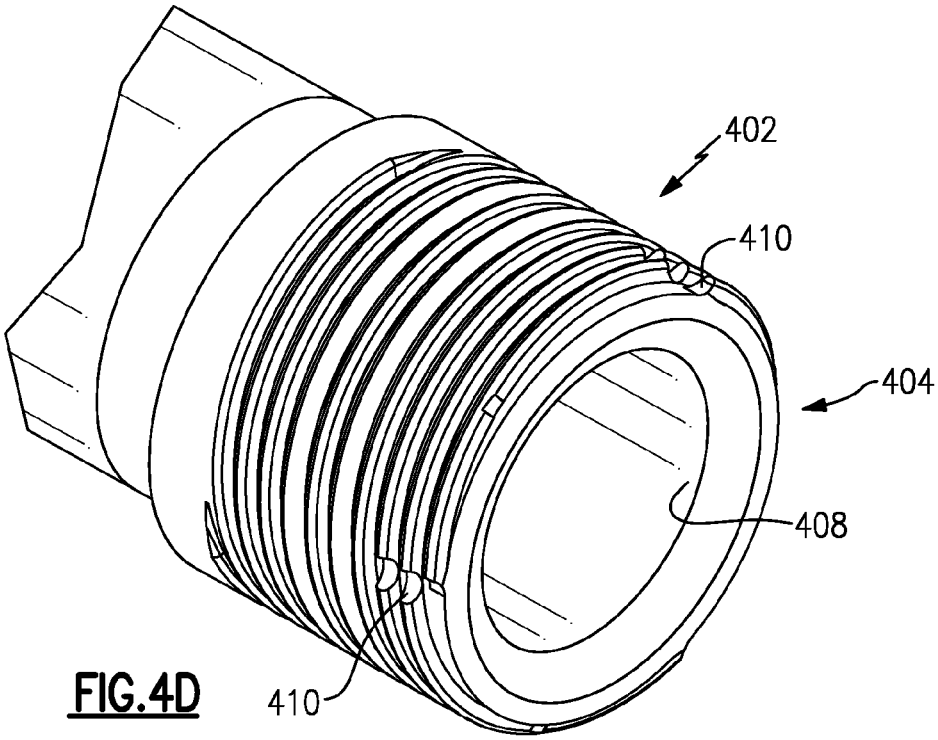
FIG. 4D is an enlarged cut-away perspective view of an end of the plate handling tool of FIG. 4A.

Referring now to FIG. 4D, an enlarged cut-away perspective view showing the first end 404 of the tool 400 in more detail is provided. In an example, the tool 400 includes one or more longitudinal grooves 410 defined through at least a portion of the threads 402. As shown, the one or more grooves 410 (also referred to herein as simply "grooves 410") extend longitudinally (in parallel with the axis 405 of rotation of the threads 402) from the first end 404 of the tool 400. Each groove 410 is made up of multiple notches in the male thread 402, wherein notches in adjacent crests of the thread 402 are aligned longitudinally with respect to the tool 400, to form the groove 410. The valley of the thread 402 can, be need not, be further indented as part of the groove 410. That is, the bottom of the groove 410 can be below, at, or above the bottom of the valley of the thread 408. The grooves 410 provide an exit path for worked material that is present on the inner surface of the central aperture 210 to escape from between the tool 400 and the inner surface of the central aperture 210 as the threads 402 of the tool 400 are engaged with the threads 214 of the plate 108. That is, as the threads 402 of the tool 400 are engaged with the threads 214 of the plate 108 in the presence of worked material, the worked material caught between the tool 400 and the surface of the central aperture 210 can be pressed out through the grooves 410. This can make is easier to engage the tool 400 with the plate 108 when the plate 108 is installed in the grinder 100.

To enable the worked material to escape from the threads 402, the grooves 410 open to (i.e., extend to) the first end 402. Thus, the grooves 410 extend to include a notch in the terminal crest of the threads 402 at their respective location. From the terminal crest of the threads 402, a given groove 410 can extend longitudinally along the tool 400 (generally transverse to the threads 402) a given length. This length of the groove 410 can be selected as desired. In the example shown in FIG. 4D, the grooves 410 extend across the three terminal crests of the threads 408. Other groove lengths can also be used, and different grooves 410 on the tool 400 can the same or different lengths. Typically, multiple grooves 410 on the tool 400 will be equally spaced around the circumference of the first end 402 as shown to provide spaced apart exits for the worked material. The example tools 400 shown herein include three equally spaced grooves 410; however, other numbers and/or spacing of grooves 410 can be used.

Figure 7:
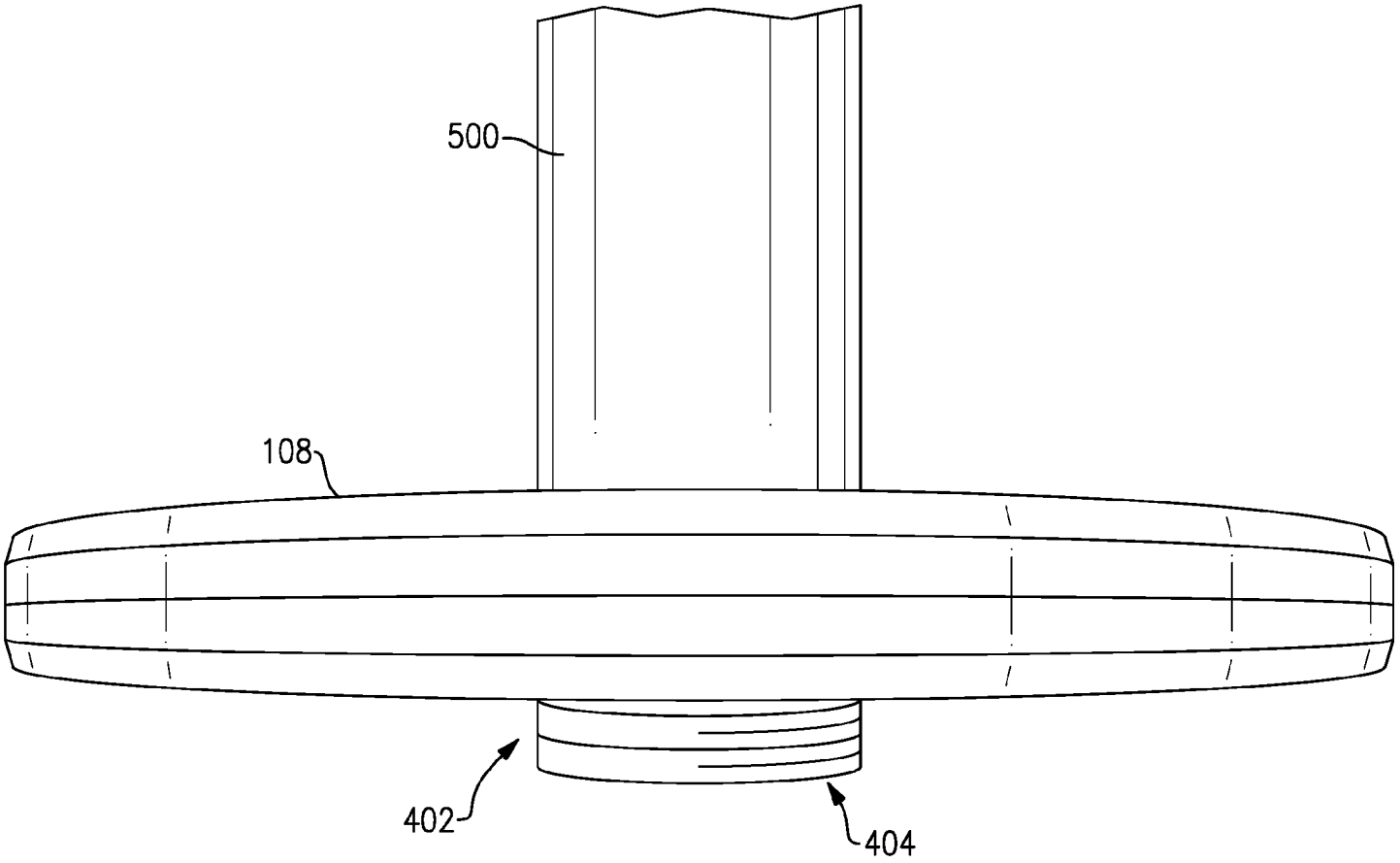
FIG. 7 is a perspective view of the plate handling tool of FIG. 5 engaged with the grinder plate of FIG. 3A such that the tool extends through the grinder plate.

Referring back to FIG. 3B along with FIG. 4D, the one or more threads 214 in the central aperture 210 of the plate 108 can extend continuously from the first face 202 to the second face 204. Correspondingly, the threads 402 on the tool 400 extend longitudinally along the tool 400 from the first end 402 for a longitudinal length greater than the thickness of the plate 108. This enables the plate handling tool 400 to be screwed into the central aperture 210 of the plate 108 starting from the second face 204 all the way through the plate 108 such that the plate handling tool 400 extends out past the first face 202 of the plate 108. FIG. 7 is a side view of the tool 500 engaged with the plate 108, showing the tool 500 extending past the first face 202 of the plate 108. During removal of a plate 108, the tool 400, 500 can extend into/through the central aperture 210 far enough to contact and bear against the knife assembly 110. The tool 400, 500 can then be further rotated to force the plate 108 away from the knife assembly 110 to release the suction therebetween during removal of the plate 108. Enabling the tool 400, 500 to extend past the first face 202 of the plate 108 enables the tool 400, 500 to move the plate 108 a sufficient distance away from the knife assembly 110 to sufficiently release the suction. In an example, the threads 402 on the tool 400, 500 extend for a longitudinal length along the tool 400, 500 that is at least one half inch longer than the width of the plate 108. For example, for a plate 108 that is about 1 inch thick, the threads 402 on the tool 400, 500 can extend at least 1.5 inches. This utilization of this feature to remove a plate 108, 200 is explained in more detail below.

Although plate 108 described herein is a plate having small material-passing apertures and is described as being used in conjunction with a knife assembly, it should be understood that the threads 214 described herein can be included on any suitable grinder plate designed for use in any position within a grinder.

Referring back to FIG. 5, in this example the tool 500 includes a threaded aperture 504 at the second end 506, which is opposite the first end 404. The threaded aperture 504 can be used to screw in a tool puller (not shown). The tool puller can bear against a stable surface/object, such at the edge of the housing extension 114 proximate the first opening 115, and can include a threaded rod which engages with the threaded aperture 504 of the tool 500. This tool puller can be used to provide increased pulling force on the tool 500 to aid in releasing the suction of the plate 108. In particular, once the tool 500 is engaged with the plate 108, the rod of the tool puller can be engaged with the threaded aperture 504 of the tool 500 and rotated to pull to the tool 500 with the plate 108 engaged thereto outward of the housing extension 114. In other examples a rod can extend internally through the bore 408 (which can extend the entire longitudinal length of the tool 500) for contacting the end of the terminus 121 on the auger 121. Once the tool 500 is engaged with the plate 108, the rod can be rotated to contact the terminus 121 and further rotated to press against the terminus 121 forcing the tool 500 with plate 108 engaged therewith away from the knife assembly 110. Once the plate 108 has moved a sufficient distance to sufficiently reduce the suction the tool 500 and plate 108 can be pulled out of the housing extension 114 by hand.

Referring now to FIGS. 3C and 4E, in an example, the threads 214 in the central aperture 210 of the plate 108 and the threads 402 in the tool 400, 500 have a rounded form (i.e., cross-sectional shape). This rounded form, such as in a non-gall thread, aids in removing worked material from within the threads. This rounded profile can aid in removing worked material when the plate 108 or tool 400, 500 is being cleaned. The rounded profile can also enable easier mating of the threads 402 of the tool 400, 500 with the threads 214 of the plate 108 in the presence of worked material. In particular, as compared to a V-form thread, the rounded profile can make it easier for the threads 402 of the tool 400, 500 to push the worked material out of the threads 214 in the plate 108 as the threads 402, 214 are engaged with one another.

As mentioned above, in this example, the threads 402, 214 are three start threads having a pitch 410 of $1/6^{th}$ of an inch, resulting in a one half inch lead 412. Additionally, the rounded form of the threads 402, 214 can have a radius of between 0.025 and 0.05 inches that extends in an arc at least one third of a circumference of a circle in length. Such a rounded form reduces the narrow valley of the threads 402, 214 as compared to a V-form thread. In this example, the arc of the threads 402, 214 meets a straight angled wall of 30 degrees which forms the base of the threads 402, 214. In an example, the threads 402, 214 are configured such that one and one-half revolutions of the tool 400, 500 causes the tool 400, 500 to travel linearly from the back face 204 of the plate 108 to the front face 202 of the plate 108. This can reduce disassembly time.

Figure 8A:
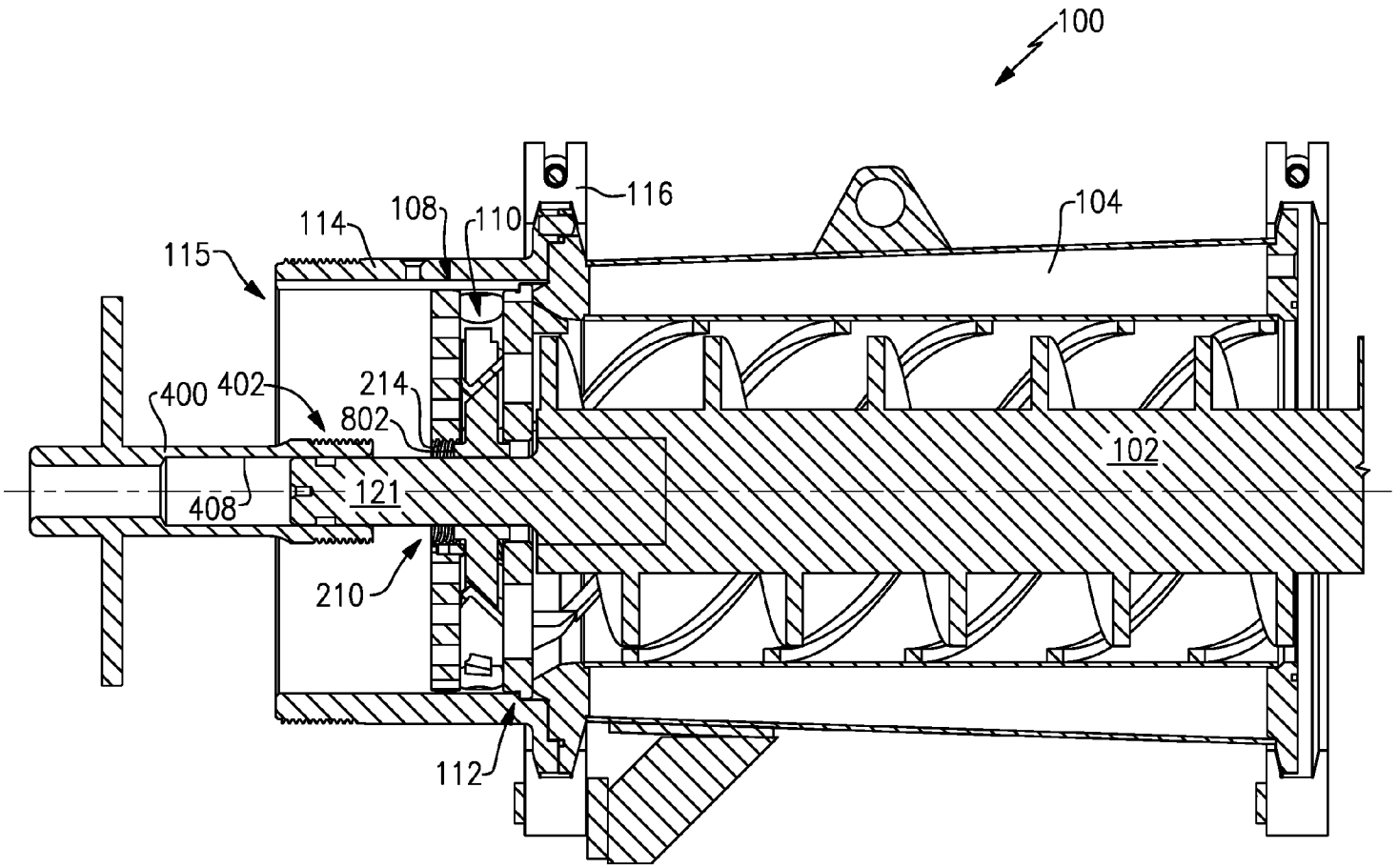
FIGS. 8A-8E are cross-sectional views of the grinder of FIG. 1A showing example stages in removal of the grinder plate of FIG. 3A from the grinder with the tool of FIG. 5.
Figure 8B:
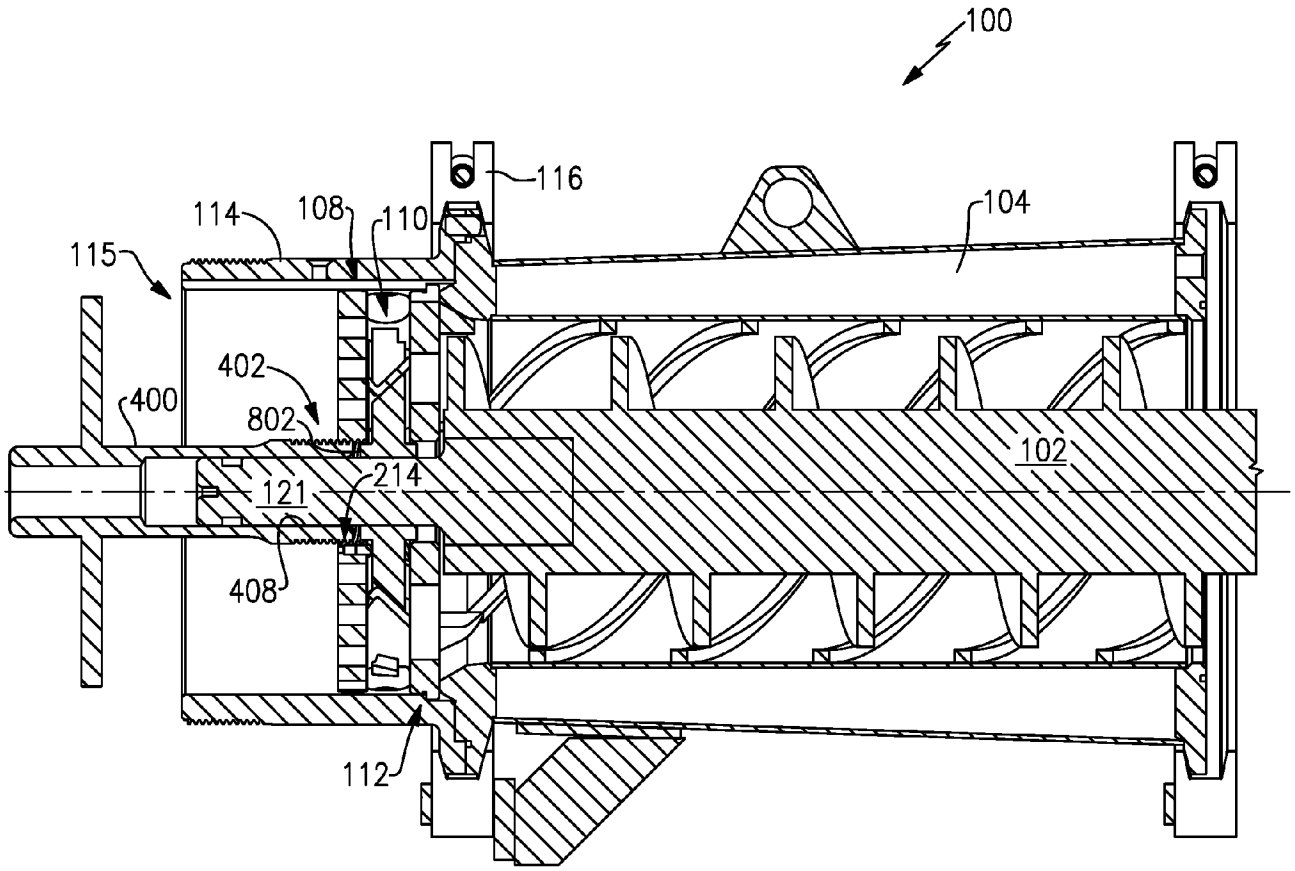
Figure 8C:
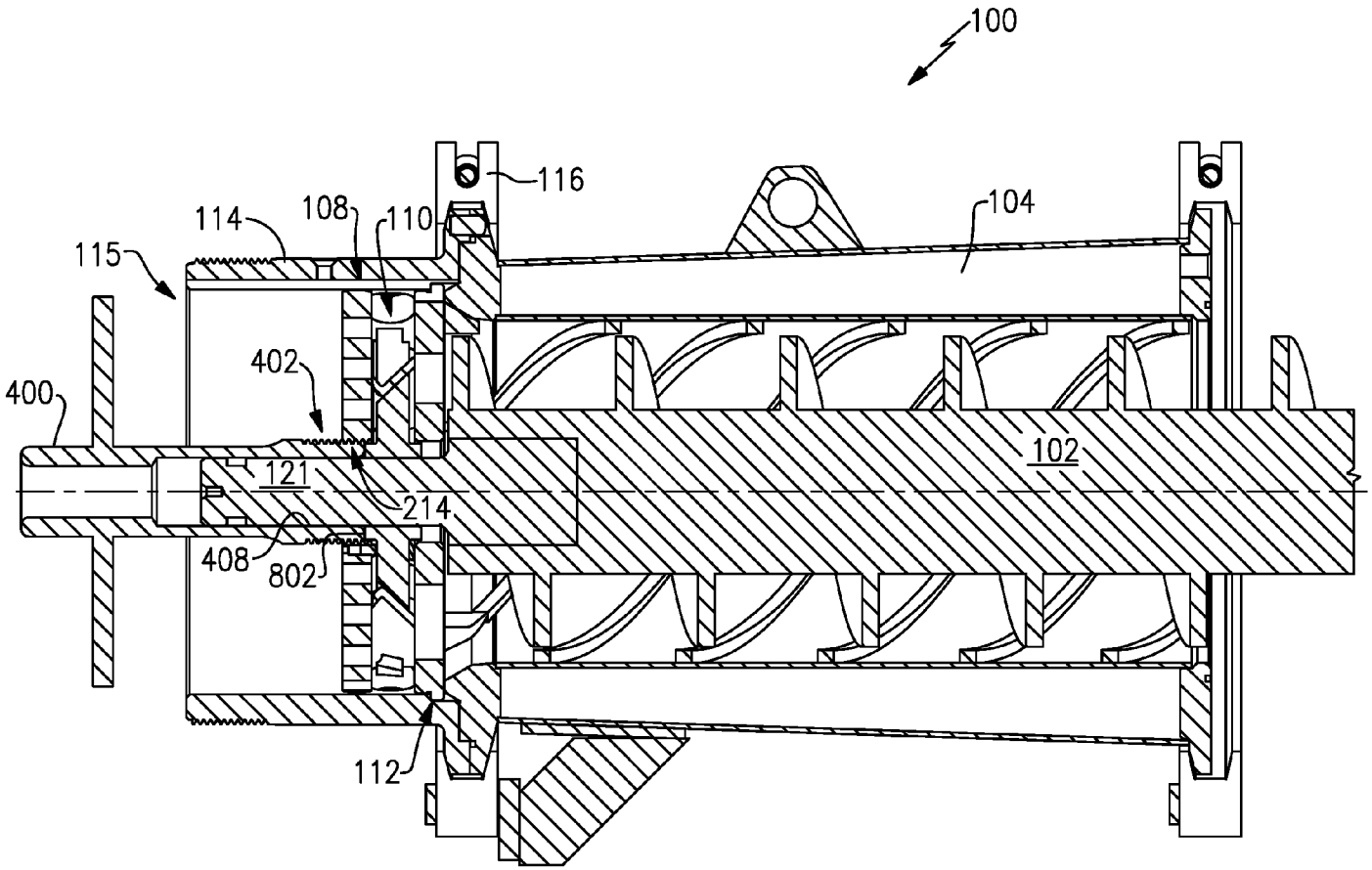
Figure 8D:
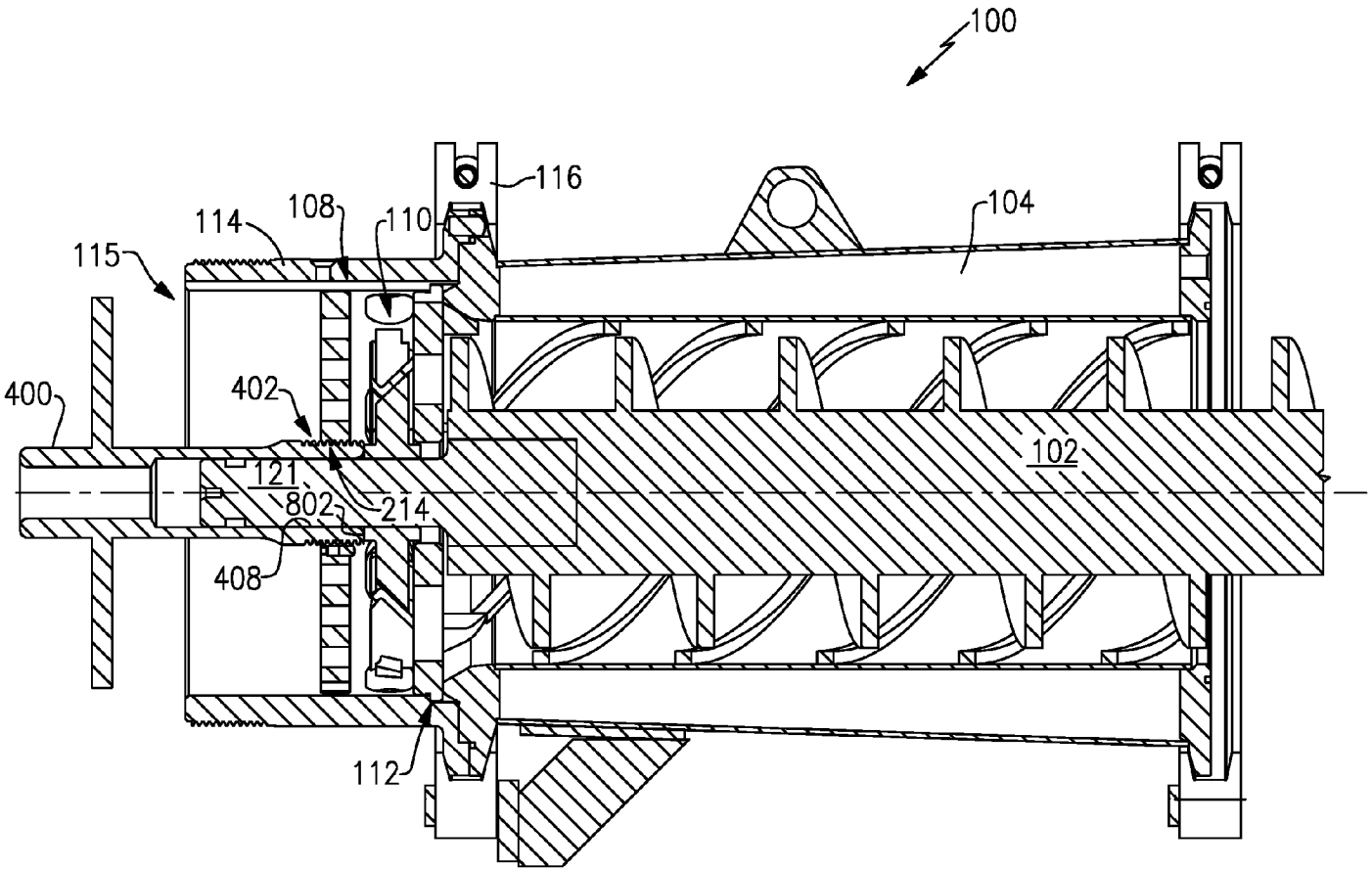
Figure 8E:
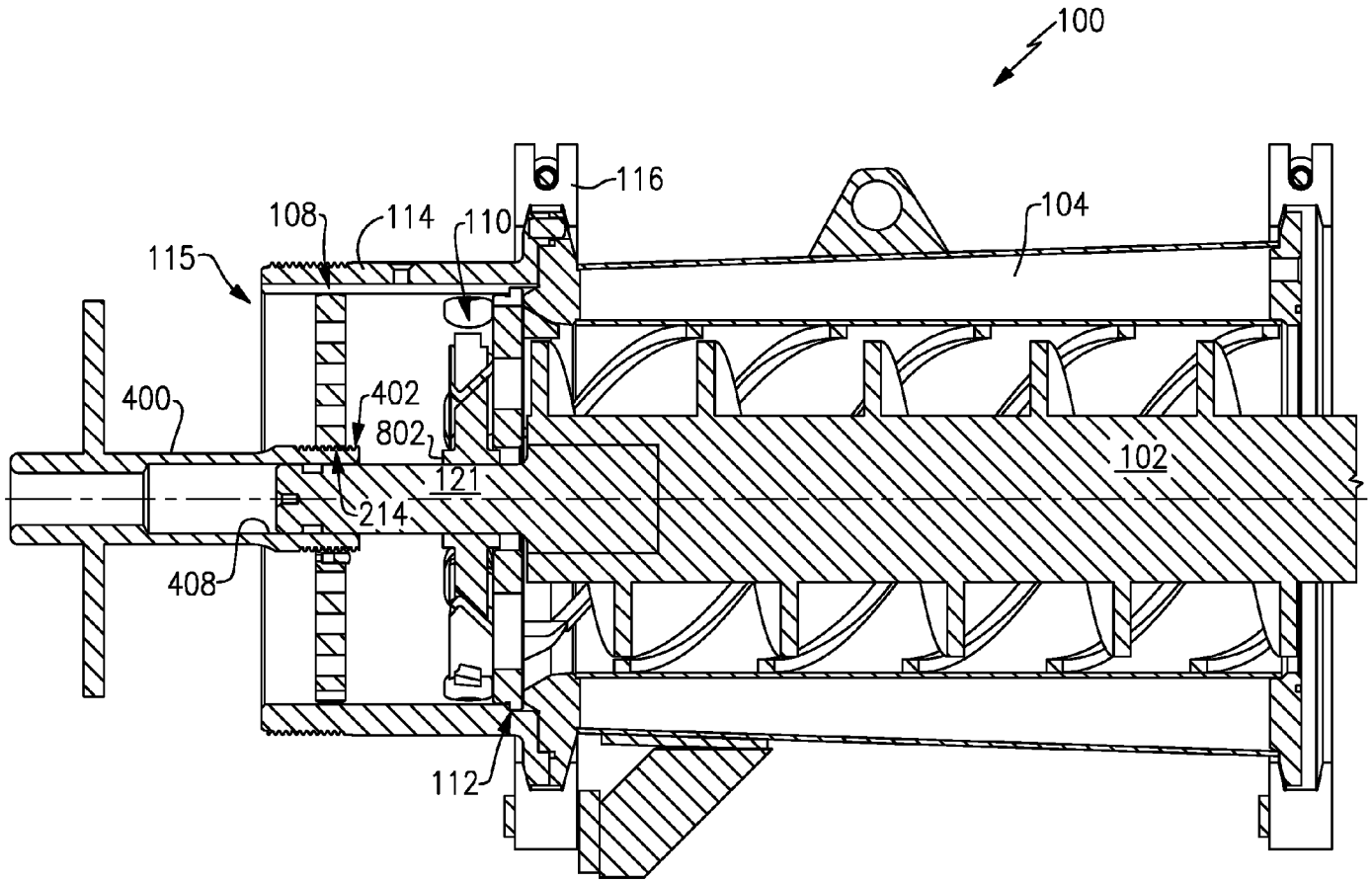

FIGS. 8A-8E are cross-sectional views of examples stages in a process of removing the plate 108 from the grinder 100. To remove the plate 108 from a grinder 100 using the tool 400, the retaining ring 126 is unfastened from the housing extension 114, and the spacer ring 124, auger support 122 with bushing 120 and bushing 118 are removed via the front opening 115 of the housing extension 114. FIGS. 8A-8E show the grinder 100 with the retaining ring 126, spacer ring 124, auger support 122 with bushing 120, and bushing 118 removed. The tool 400 can then be inserted through the front opening 115 of the grinder housing extension 114. As shown in FIG. 8A, the tool 400 is slid over the terminus 121 of the auger 102, such that the terminus 121 is inside the bore 408 of the tool 400. As shown in FIG. 8B, the tool 400 is pushed farther forward (slid further onto the terminus 121) to contact the second face 204 of the plate 108 at the central aperture 210. The tool 400 can then be rotated to engage the threads 402 of the tool 400 with the threads 214 of the central aperture 210. In an example, once the tool 400 is sufficiently engaged with the plate 108, the tool 400 can be pulled out of the housing extension 114, which pulls the engaged plate 108 out with the tool 400. As mentioned above, however, in some situations suction caused by worked material behind the plate 108 can make it difficult to simply pull out the plate 108, even with the tool 400. Accordingly, in some examples the tool 400 can be further rotated as shown in FIG. 8C to engage the tool 400 further into the plate 108 such that the first end 404 of the tool 400 contacts a flange 802 of the knife assembly 110 behind the plate 108 with the tool 400. As shown in FIG. 8D, after contacting the knife assembly 110, the tool 400 can be rotated while maintaining contact with the knife assembly 110, which applies counter-force to the plate 108 drawing the plate 108 away from the knife assembly 110. The tool 400 can be further rotated until the plate 108 has been drawn away from the knife assembly 110 a sufficient distance to sufficiently release the suction on the plate 108. During this process the tool 400 can be rotated such that the tool 400 extends out from the first face 202 of the plate 108. Once the suction has been sufficiently released behind the plate 108, the tool 400 with the plate 108 engaged therewith can be pulled out of the front opening 115 of the housing extension 114 as shown in FIG. 8E.

The tool 400 can also be used to install the plate 108 in the housing extension 114 by engaging the tool 400 with the plate 108. The tool 400 engaged with the plate 108 can then be moved into the housing extension 114 via the front opening 115 until the plate 108 is in its desired location adjacent the knife assembly 110. The tool 400 can then be rotated to disengage from the plate 108. Once disengaged from the plate 108, the tool 400 can be pulled out of the front opening 115 of the housing extension 114 leaving the plate 108 in place therein.

In some examples, the grinder 100 can be a Wolfking® or Seydelmann® brand grinder. Advantageously, a grinder plate can be made as described and shown herein while being compatible with conventional industrial grinders, and can have the same IDs as conventional grinder plates.

What is claimed is:

1. A system for a food grinder, the system comprising:

a grinder plate configured to be installed within a food grinder, the grinder plate having a disk-shaped body with a first face, a second face, and a side, the disk-shaped body defining:

a central cylindrical aperture extending from the first face to the second face, the central aperture coaxial with a central axis of the disk-shaped body;

a plurality of material-passing apertures extending from the first face to the second face, the material-passing apertures disposed between the central aperture and the side; and a first one or more screw threads defined in the central aperture; and a tool for removing the grinder plate from or installing the grinder plate into a food grinder, the tool having an elongated body defining:

a first end having a cylindrical geometry;

a second one or more screw threads on an external surface proximate the first end, wherein an axis of the second one or more screw threads is aligned with a central longitudinal axis of the elongated body; and at least one of:

a head defining a plurality of flat surfaces disposed as sides of a regular polygon, the regular polygon having a center aligned with the central axis of the elongated body; or one or more handles extending from the elongated body, the one or more handles projecting outward in a perpendicular direction to the central axis of the elongated body, wherein the first one or more screw threads are configured to mate with the second one or more screw threads.

2. The system of claim 1, wherein the first one or more screw threads are female threads and the second one or more screw threads are male threads.

3. The system of claim 1, wherein the first and second one or more screw threads have a rounded form.

4. The system of claim 1, wherein the first one or more screw threads extend continuously through the grinder plate from the first face to the second face, wherein the second one or more screw threads extend longitudinally along the tool for a longitudinal length greater than a distance from the first face to the second face of the grinder plate.

5. The system of claim 1, wherein the body of the grinder plate defines:

an exclusion region around the central aperture, wherein there are no material-passing apertures in the exclusion region, the exclusion region extending radially outward from an edge of the central aperture for a distance in the range of 0.25 to 2 inches; and a bone pin aperture within the exclusion region, the bone pin aperture configured to have a pin inserted therein and having a diameter different than the material passing apertures.

6. The system of claim 1, wherein the tool defines:

a bore in the first end, the bore having a cylindrical geometry, the cylindrical geometry coaxial with the axis of the second one or more screw threads, wherein a wall defining the bore is less than one half inch thick.

7. The system of claim 1, wherein the tool defines:

one or more grooves through at least a portion of the second one or more screw threads, the one or more grooves extending from the first end in a direction parallel with the axis of the second one or more screw threads, wherein the one or more grooves open to the first end.

8. The system of claim 1, wherein the food grinder is configured to grind one or more of whole animals, animal parts, whole vegetables, or vegetable parts for human, pet, or livestock food.

9. A system for an industrial animal or vegetable grinder, the system comprising:

a grinder plate configured to be installed within an industrial animal or vegetable grinder, the grinder plate having a disk-shaped body with a first face, a second face, and a side, the disk-shaped body defining:

a central cylindrical aperture extending from the first face to the second face, the central aperture coaxial with a central axis of the disk-shaped body;

a plurality of material-passing apertures extending from the first face to the second face, the material-passing apertures disposed between the central aperture and the side; and a first one or more screw threads defined in the central aperture; and a tool for removing the grinder plate from or installing the grinder plate into an industrial animal or vegetable grinder, the tool having an elongated body defining:

a first end having a cylindrical geometry;

a second one or more screw threads on an external surface proximate the first end, wherein an axis of the second one or more screw threads is aligned with a central longitudinal axis of the elongated body; and one or more handles extending from the elongated body, the one or more handles projecting outward in a perpendicular direction to the central axis of the elongated body, wherein the first one or more screw threads are configured to mate with the second one or more screw threads.

10. The system of claim 9, wherein the first one or more screw threads are female threads and the second one or more screw threads are male threads.

11. The system of claim 9, wherein the first and second one or more screw threads have a rounded profile.

12. The system of claim 9, wherein the first one or more screw threads extend continuously through the grinder plate from the first face to the second face, wherein the second one or more screw threads extend longitudinally along the tool for a longitudinal length greater than a distance from the first face to the second face of the grinder plate.

13. The system of claim 9, wherein the body of the grinder plate defines:

an exclusion region around the central aperture, wherein there are no material-passing apertures in the exclusion region, the exclusion region extending radially outward from an edge of the central aperture for a distance in the range of 0.25 to 2 inches.

14. The system of claim 9, wherein the tool defines:

a bore in the first end, the bore having a cylindrical geometry, the cylindrical geometry coaxial with the axis of the second one or more screw threads, wherein a wall defining the bore is less than one half inch thick.

15. The system of claim 9, wherein the one or more handles of the tool include a plurality of rods extending in respective directions perpendicular to the central axis of the longitudinal body.

16. The system of claim 15, wherein the plurality of rods consists of a pair of co-linear rods.

17. The system of claim 9, wherein the tool defines:

one or more grooves through at least a portion of the second one or more screw threads, the one or more grooves extending from the first end in a direction parallel with the axis of the second one or more screw threads, wherein the one or more grooves open to the first end.

* * * * *